US012167824B2

(12) United States Patent
Grebing

(10) Patent No.: US 12,167,824 B2
(45) Date of Patent: Dec. 17, 2024

(54) PARTICLE RECEIVING DEVICE, ARRANGEMENT AND METHOD FOR OPERATING AN ARRANGEMENT

(71) Applicant: FESTOOL GMBH, Wendlingen (DE)

(72) Inventor: Gerhard Grebing, Nurtingen (DE)

(73) Assignee: Festool GmbH, Wendlingen (DE)

( * ) Notice: Subject to any disclaimer, the term of this patent is extended or adjusted under 35 U.S.C. 154(b) by 935 days.

(21) Appl. No.: 17/259,231

(22) PCT Filed: Jul. 10, 2019

(86) PCT No.: PCT/EP2019/068490
§ 371 (c)(1),
(2) Date: Jan. 11, 2021

(87) PCT Pub. No.: WO2020/011828
PCT Pub. Date: Jan. 16, 2020

(65) Prior Publication Data

US 2021/0251448 A1 Aug. 19, 2021

(30) Foreign Application Priority Data

Jul. 13, 2018 (DE) ..... 10 2018 211 710.1

(51) Int. Cl.
*B01D 46/00* (2022.01)
*A47L 7/00* (2006.01)
(Continued)

(52) U.S. Cl.
CPC ..... *A47L 9/1454* (2013.01); *A47L 7/0095* (2013.01); *A47L 9/1418* (2013.01)

(58) Field of Classification Search
CPC ..... B01D 46/02; B01D 46/48; A47L 9/127; A47L 9/1445; A47L 9/1448; A47L 9/1454; A47L 7/0095
(Continued)

(56) References Cited

U.S. PATENT DOCUMENTS 5,230,724 A * 7/1993 Marafante ..... A47L 9/1445 55/377
5,725,620 A * 3/1998 Perea ..... B01D 46/02 55/369
(Continued)

FOREIGN PATENT DOCUMENTS

CN 101172025 5/2008
CN 101313832 12/2008
(Continued)

OTHER PUBLICATIONS

Office Action issued in corresponding German Patent Application No. 10 2018 211 710.1, Sep. 18, 2023, 8 pages.
(Continued)

*Primary Examiner* — Minh Chau T Pham
(74) *Attorney, Agent, or Firm* — HSML P. C.

(57) ABSTRACT

A particle receiving device for attachment to a particle outlet of a vacuum cleaner and/or of a cyclone separator and for receiving separated particles, including: a particle receiving volume for receiving the particles, an access element with an access element opening through which the particles can be transported into the particle receiving volume, and a closure element. The access element is selectively displaceable relative to the closure element into a closure position in which the closure element closes access opening, or into an open position in which the closure element releases the access element opening.

14 Claims, 13 Drawing Sheets

(51) Int. Cl.
*A47L 9/14* (2006.01)
*B01D 46/48* (2006.01)

(58) Field of Classification Search
USPC ..... 55/367, DIG. 2, DIG. 3; 15/347, 352, 15/353
See application file for complete search history.

(56) References Cited

U.S. PATENT DOCUMENTS

| | | | | |
|---|---|---|---|---|
| 5,820,643 | A | 10/1998 | Lienenluke et al. | |
| 6,224,645 | B1 * | 5/2001 | Rydin | A47L 9/1445 55/377 |
| 6,802,879 | B2 * | 10/2004 | Scanlon | B01D 46/48 55/377 |
| 7,799,107 | B2 * | 9/2010 | Corney | A47L 9/1445 55/377 |
| 8,956,432 | B2 * | 2/2015 | Herndon | A47L 9/127 55/374 |
| 10,307,030 | B2 * | 6/2019 | Schultink | A47L 9/1445 |
| 2002/0020155 | A1 | 2/2002 | Stokmans | |

FOREIGN PATENT DOCUMENTS

| | | | |
|---|---|---|---|
| CN | 202288130 | U | 7/2012 |
| CN | 103876686 | | 6/2014 |
| CN | 108078493 | | 5/2018 |
| DE | 44 15 350 | | 11/1995 |
| DE | 20005448 | U1 | 6/2000 |
| DE | 102016101697 | A1 | 8/2017 |
| EP | 0 796 586 | | 9/1997 |
| EP | 3 326 507 | | 5/2018 |
| JP | 2001-029287 | | 2/2001 |
| WO | 2017194085 | A1 | 11/2017 |

OTHER PUBLICATIONS

International Search Report and Written Opinion in corresponding PCT/EP2019/068490, dated Sep. 30, 2019.
German Search Report in corresponding German Application No. 102018211710.1, dated Jun. 7, 2019.
Office Action issued in corresponding Chinese Patent Application No. 2019800469941, Aug. 27, 2021, 17 pages w/ translation.

* cited by examiner

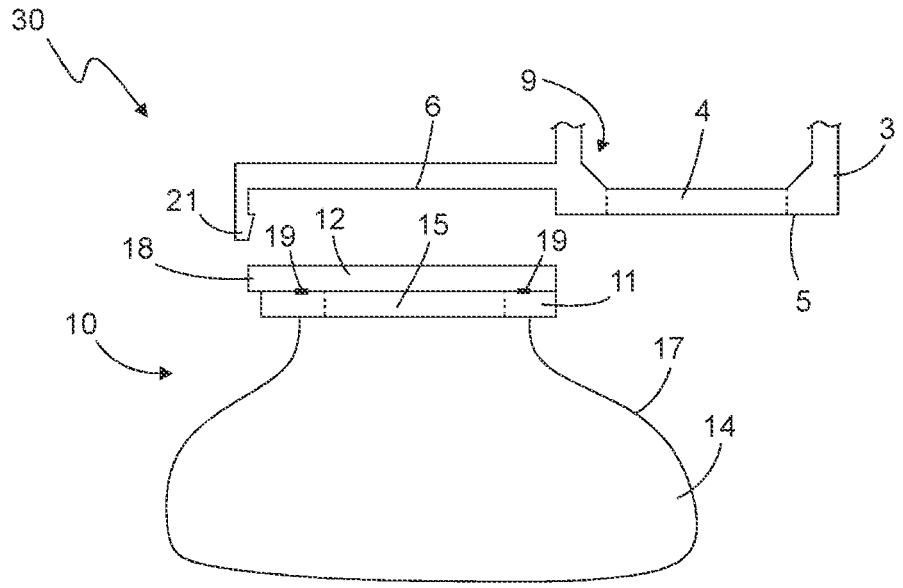
Fig. 1
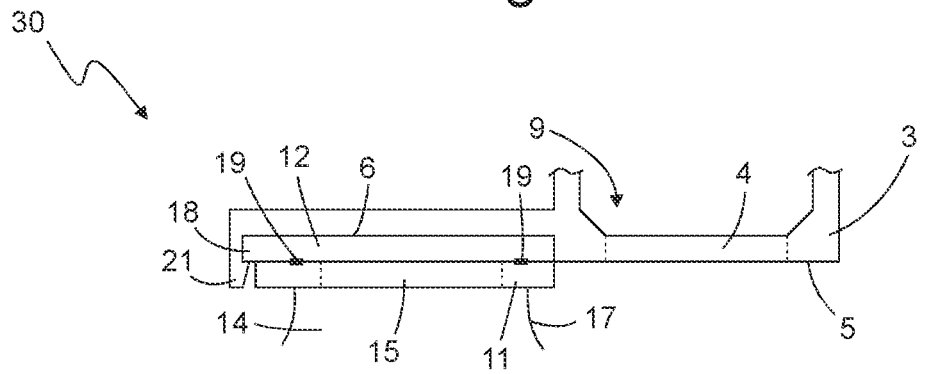
Fig. 2
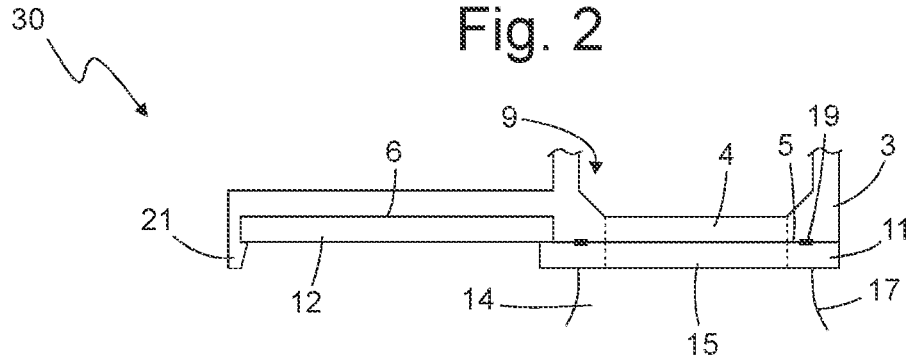
Fig. 3
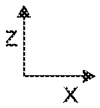

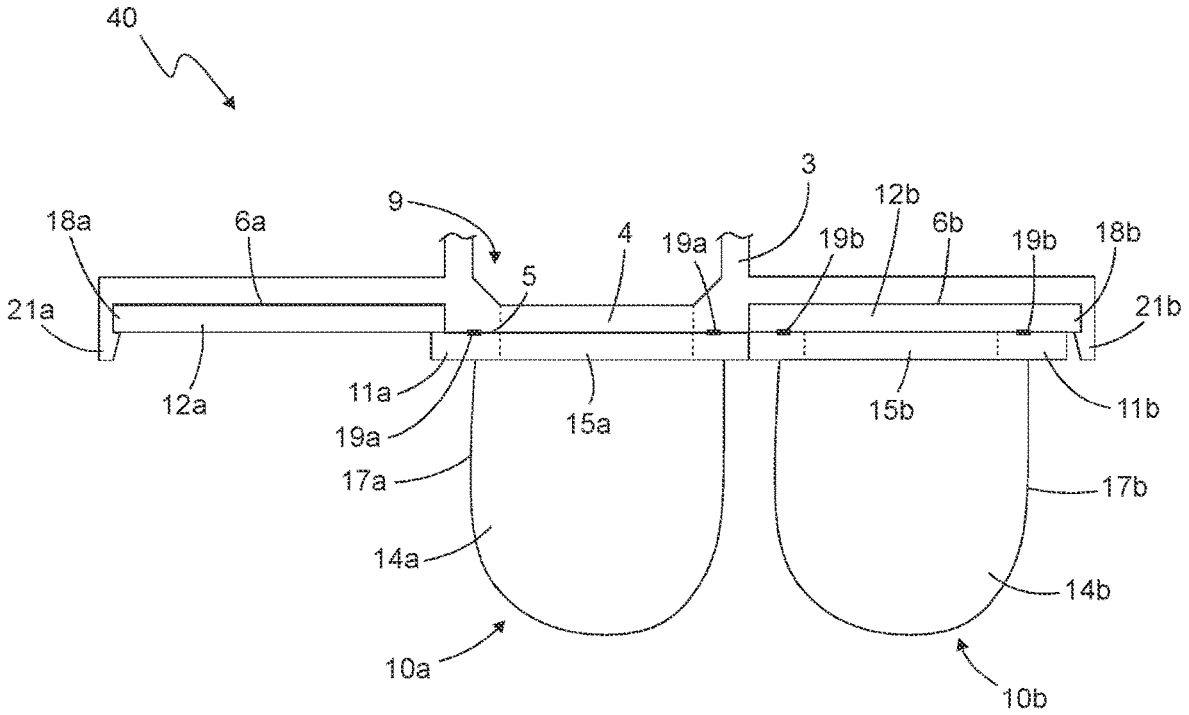
Fig. 4
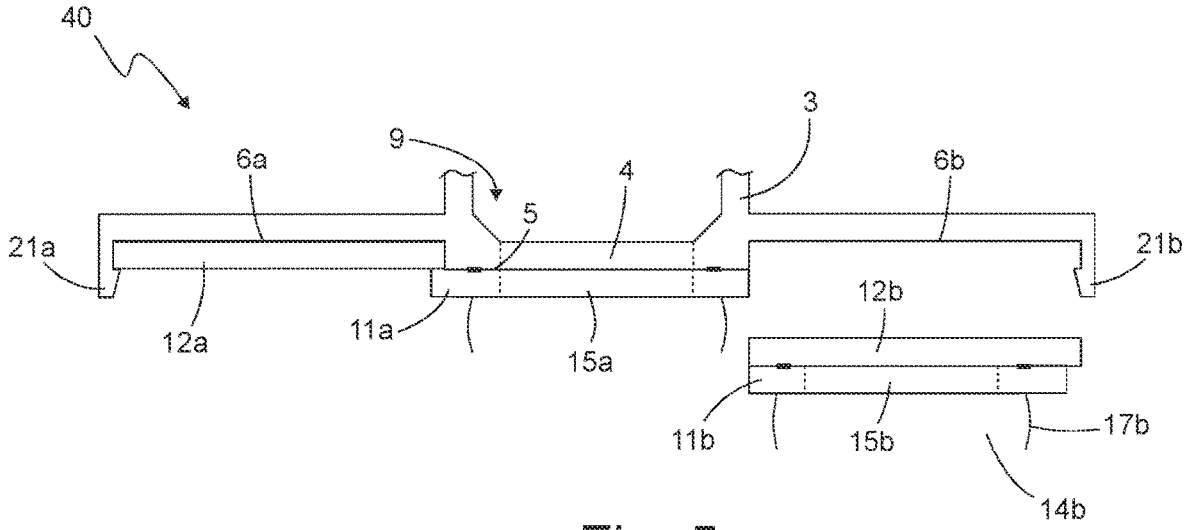
Fig. 5
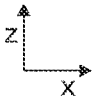

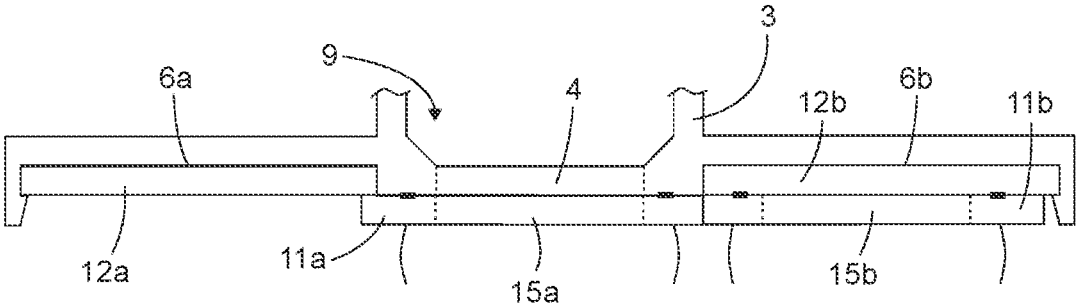
Fig. 6
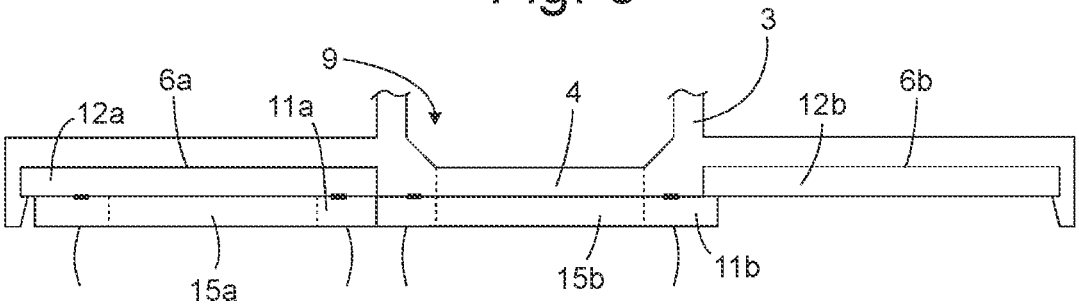
Fig. 7
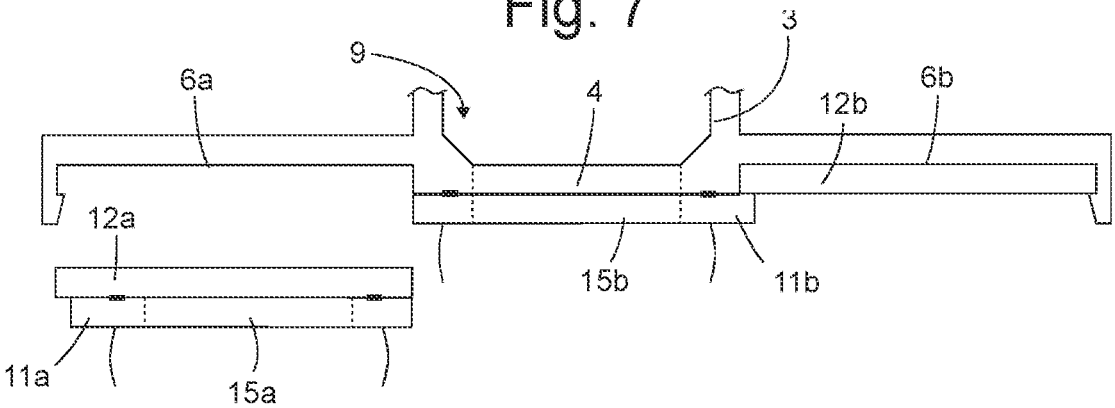
Fig. 8
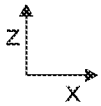

PARTICLE RECEIVING DEVICE, ARRANGEMENT AND METHOD FOR OPERATING AN ARRANGEMENT

The invention relates to a particle receiving device for attachment to a particle outlet of a vacuum cleaner and/or of a cyclone separator and for receiving separated particles. The particle receiving device comprises a particle receiving volume for receiving the particles and an access element with an access element opening. Particles can be transported into the particle receiving volume through the access element opening.

BACKGROUND OF THE INVENTION

The particle receiving volume is provided for example by way of a bag and/or a container. The bag and/or the container are expediently fastened to the access element.

In operation, particles are separated by the vacuum cleaner and/or the cyclone separator and are output out of the particle outlet. The particles get into the particle receiving volume via the access element and are collected there.

SUMMARY OF THE INVENTION

It is an object of the invention to increase the operational safety of the particle receiving: device.

This object is achieved by the subject-matter according to the present disclosure. The particle receiving device comprises a closure element. The access element is selectively displaceable relative to the closure element into a closure position or into an open position. In the closure position, the closure element closes access opening. In the open position, the closure element releases the access element opening.

By way of bringing the access element into the closure position, the access element opening can consequently be closed, so that the probability of particles getting out of the particle receiving volume into the environment and contaminating this can be reduced. The operational safety can be increased in this manner, in particular when the particles are particles which are harmful to health.

In particular, the access element can be brought into the closure position in a state in which the particle receiving device is attached to the particle outlet-thus before a removal of the particle receiving device from the particle outlet.

Preferably, the access element can be moved directly from the open position, in which it is located directly below the particle outlet and in particular directly below a particle outlet opening, into the closure position, in which the upper side of the access element is expediently located completely below the closure element and is covered by this. The access element opening is expediently always closed in every position of the access element and/or is located below the particle outlet opening, so that the risk of a contamination of the environment is reduced.

The regions which are contaminated by particles can also be denoted as a black region or contamination region and the non-contaminated region as a white region or clean region. By way of the closure of the particle receiving device at the particle outlet, the separation between the black region and the white region can be improved, and in particular one succeeds in the black region of the particle receiving device being closed with respect to the environment in particular after the removal from the particle outlet, so that the risk of a contamination is reduced.

Advantageous further developments are the subject-matter of the dependent claims.

According to a possible design, the access element comprises an upper side which in the open position of the access element represents an outer side of the particle receiving device and can be applied onto the particle outlet.

According to a further design, the closure element is arranged on the upper side of the access element.

According to a further design, the particle receiving device comprises a bag and/or a container for providing the particle receiving volume, wherein the bag and/or the container is fastened to the access element and is movable together with the access element relative to the closure element.

According to a further design, when the access element is situated in the closure position, the closure element completely covers the access element upper side which can be applied onto the particle outlet.

According to a further design, the closure element comprises a closure element coupling section, with which the closure element can be fastened to the particle outlet.

The invention further relates to an arrangement comprising a particle receiving device which is described here, as well as the particle outlet which comprises a particle outlet opening, wherein the particle receiving device is attached to the particle outlet.

According to a possible design, the particle receiving volume is closed with respect to the environment in every possible position of the access element relative to the closure element.

According to a further design, the particle receiving device is a first particle receiving device and the arrangement further comprises a second particle receiving device with a second closure element and with a second access element which comprises a second access element opening, wherein the second access element can be selectively brought into an open position or a closure position, wherein in the closure position the second access element opening is closed by the second closure element.

According to a further design, the first access element and the second access element together as a group can be selectively brought into a first position or a second position, wherein in the first position the first access element is in the open position and the second access element in the closure position, and in the second position the first access element is in the closure position and the second access element in the open position.

According to a further design, in the first position, the second position and in all positions between the first position and the second position, the particle receiving volumes of the particle receiving devices and the particle outlet inner volume of the particle outlet are closed with respect to the environment.

According to a further design, the particle outlet comprises a closure element receiving section which is distanced to the particle outlet opening and the closure element is located completely in the closure element receiving section.

According to a further design, the arrangement comprises a blocking mechanism which prevents the particle receiving device from being able to be removed from the particle outlet in a position other than the closure position.

According to a further design, the arrangement comprises a locking mechanism which, depending on whether the particle receiving device is attached to the particle outlet, locks the closure element with respect to the access element, wherein in a state in which the particle receiving device is removed from the particle outlet, the locking mechanism locks the access element in the closure position, and in a state in which the particle receiving device is attached to the particle outlet, unlocks the access element, so that it can be brought into the open position.

The invention further relates to a method for operating an arrangement which is described here, comprising the steps:

- attaching the particle receiving device to the particle outlet, wherein the access element is situated in the closure position,
- bringing the access element into the open position,
- transporting particles into the particle receiving volume,
- bringing the access element into the closure position, wherein the particle receiving volume remains closed with respect to the environment,
- removing the particle receiving device from the particle outlet, wherein the particle receiving volume is closed with respect to the environment, According to a preferred design, the method further comprises the steps:

- attaching the first particle receiving device to the particle outlet, wherein the first access element is situated in the closure position,
- bringing the first access element into the open position,
- transporting the particles into the first particle receiving volume,
- attaching the second particle receiving device to the particle outlet, wherein the second access element is situated in the closure position,
- commonly bringing the first access element into the closure position and the second access element into the open position, wherein the particle receiving volumes are closed with respect to the environment,
- removing the first particle receiving device from the particle outlet, wherein the first particle receiving volume remains closed with respect to the environment.

BRIEF DESCRIPTION OF THE DRAWINGS

Exemplary details and preferred embodiments are explained hereinafter with reference to the figures. Herein are shown:

FIG. 1 a schematic view of an arrangement according to a first embodiment, comprising a particle outlet and a particle receiving device, FIG. 2 the arrangement according to the first embodiment, wherein the particle receiving device is attached to the particle outlet, FIG. 3 the arrangement according to the first embodiment, wherein the access element is situated in the open position, FIG. 4 an arrangement according to the second embodiment, comprising a particle outlet and two particle receiving devices, FIG. 5 the arrangement according to the second embodiment, wherein a first particle receiving device is attached to the particle outlet, FIG. 6 the arrangement according to the second embodiment, wherein both particle receiving devices are attached to the particle outlet and the access elements are situated in a first position, FIG. 7 the arrangement according to the second embodiment, wherein the access elements are situated in a second position, FIG. 8 the arrangement according to the second embodiment, wherein the first particle receiving device is removed from the particle outlet, FIG. 9 a schematic view of a construction with a cyclone separator and a suction device, FIG. 10 an exemplary design of the arrangement according to the second embodiment, wherein the access elements are situated in the first position, FIG. 11 the design of FIG. 10, wherein the access elements are situated in a second position, FIG. 12 a sectioned view of the design, FIG. 13 a perspective view from below upon an exemplary design of an assembly of a closure element and of an access element, FIG. 14 a perspective view from below upon the access element, FIG. 15 a perspective view from above upon the access element, FIG. 16 a perspective view from below upon the closure element, FIG. 17 a perspective view from above upon the closure element, FIG. 18 a perspective view from below upon the particle outlet, FIG. 19 an attachment of the closure element to the particle outlet, FIG. 20 a perspective view of the particle outlet from above.

DETAILED DESCRIPTION OF THE INVENTION

Figure 9:
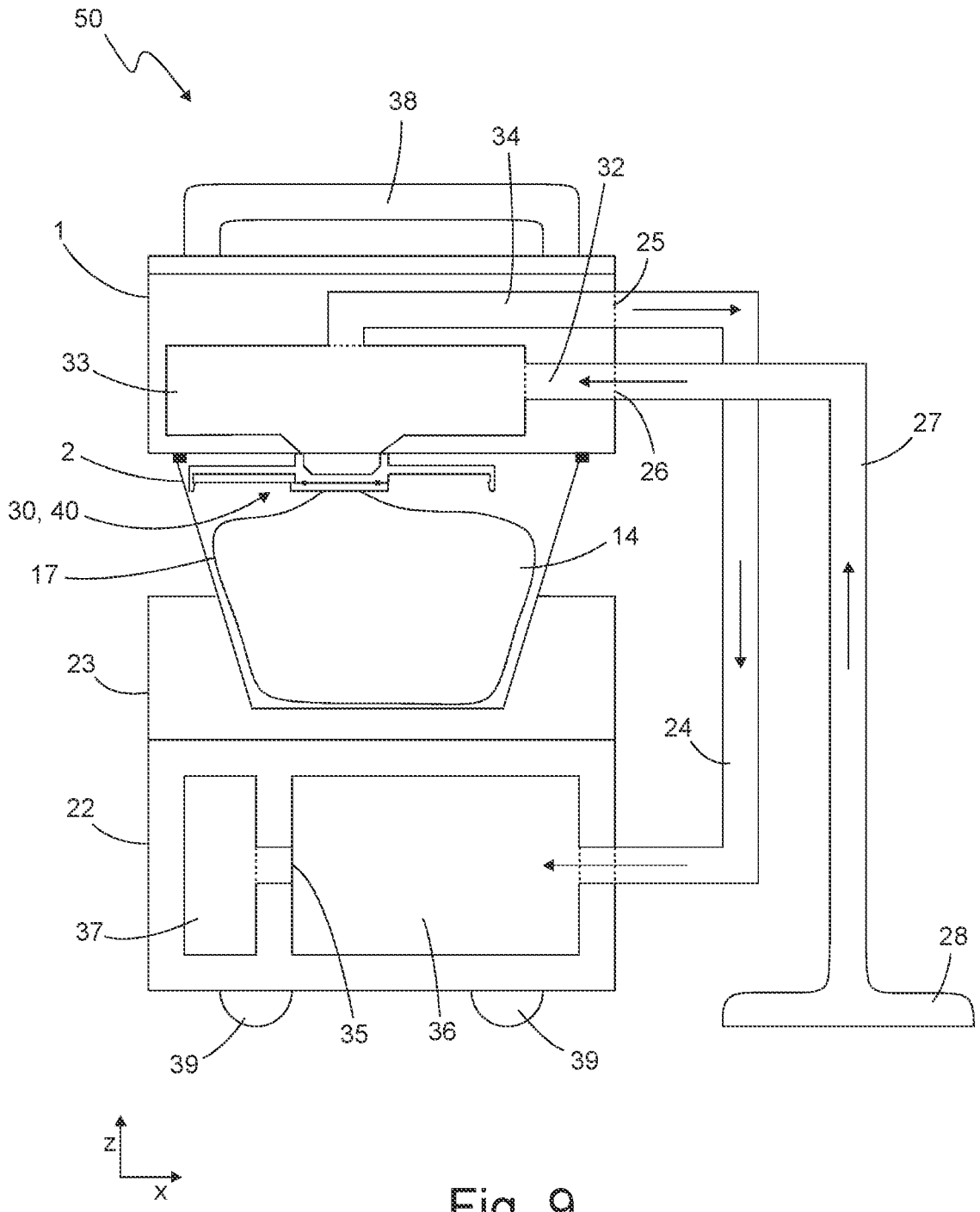

FIGS. 1 to 3 relate to a first embodiment and show a particle receiving device 10 together with a particle outlet 3. The particle receiving device 10 can, in general, also be provided on its own-thus in particular without the particle outlet 3. The combination of the particle receiving device 10 and the particle outlet 3 is denoted as an arrangement 30.

FIG. 1 shows the particle receiving device 10 in a state in which it is removed from the particle outlet 3. In the FIGS. 2 and 3, the particle receiving device 10 is shown in a state in which it is attached to the particle outlet 3.

The particle receiving device 10 is designed for attachment onto the particle outlet 3. The particle outlet 3 is for example a particle outlet 3 of vacuum cleaner and/or of a cyclone separator 1. The particle receiving device 10 is designed to receive and in particular to collect particles which are separated by a vacuum cleaner and/or a cyclone separator 1 and output via the particle outlet 3.

The particle receiving device 10 comprises a particle receiving volume 14 for receiving the particles. The particle receiving device 10 further comprises an access element 11 with an access element opening 15. The separated particles can be transported into the particle receiving volume 14 via the access element opening 15.

Furthermore, the particle receiving device 10 comprises a closure element 12. The access element 11 can be selectively brought into a closure position or an open position relative to the closure element 12. The closure position is shown for example in FIGS. 1 and 2 and the open position in FIG. 3. In the closure position, the closure element 12 closes the access element opening 15. In the open position, the closure element 12 releases the access element opening 15.

Hereinafter, further exemplary details and embodiments are discussed. Herein, the spatial directions "x", "y", "z" which are drawn in the figures and are aligned orthogonally to one another are referred to as the "x-direction, "y-direction" and "z-direction".

Firstly to the access element 11:

The access element 11 by way of example comprises a plate-shaped access element body. The access element 11 comprises a lower side which faces the particle receiving volume 14 and an upper side which faces the closure element 12 (in the closure position) and/or the particle outlet 3. The lower side and the upper side are opposite to one another and by way of example are aligned normally to the z-direction. Expediently, the lower side and the upper side are each sides of the access element 11 which are largest with regard to surface area.

The access element 11 comprises the access element opening 15. By way of example, the access element opening 15 is an opening from the upper side to the lower side of the access element 11. Expediently, the access element opening 15 is circular. Preferably, the access element opening assumes at least 40% of the x-y base surface of the access element 11.

The access element 11 is attached to a bag 17 which encloses the particle receiving volume 14. Alternatively to this, the access element can also be attached to a container. The access element opening 15 provides an access to the particle receiving volume 14, expediently the only access to the particle receiving volume 14. The bag 17 or the container by way of example is attached to the lower side of the access element 11 and in particular is permanently positively and/or in a force-fitting manner connected to the access element 11. The bag 17 or the container by way of example is connected to the access element 11 by way of a chemical or physical connection. In FIGS. 2 and 3, the bag 17 is not shown completely for reasons of space.

By way of example, the access element 11 comprises a seal 19 which on the upper side is arranged around the access element opening 5. The seal 19 is preferably annular. If the particle receiving device 10 is attached to the particle outlet 3 and the access element 11 is situated in the closure position, as is shown in FIG. 2, then the seal 10 bears on the lower side of the closure element 12 and seals the particle receiving volume 14 with respect to the environment. If the access element 11 is situated in the closure position, as is shown in FIG. 3, then the seal 19 bears on the lower side of the particle outlet 3 and seals a contamination volume which is formed from the particle receiving volume 14, the access element opening 15, the particle outlet opening 4 and the particle outlet inner volume 9, with respect to the environment.

Alternatively or additionally to this, a seal can also be present on the lower side of the closure element 12 and/or on the lower side of the particle outlet 3, in order to provide the one or both aforementioned sealings with respect to the environment.

Expediently, one, several or all of the mentioned seals are designed as a labyrinth seal.

The access element 11 by way of example can be displaced in the x-direction and can hence be selectively brought into the open position or the closure position. In FIG. 2 (where the access element 11 is situated in the closure position), the access element 11 must be displaced for example to the right, in order to assume the open position.

In a state in which the particle receiving device 10 is attached to the particle outlet 3, the access element 11 can preferably be displaced exclusively between the open position and the closure position, wherein in every possible displacement position of the access element 1 the access element opening 15 is either closed and/or together with the particle outlet opening 4 provides the access to the particle receiving volume 4. According to a preferred embodiment, the access element opening 15 is closed with respect to the environment in every displacement position of the access element 11.

Now to the closure element 12:

The closure element 12 comprises a plate-shaped closure element body. The closure element 12 comprises a lower side which faces the access element 11 (in the closure position) and an oppositely directed upper side. The lower side and the upper side are preferably the sides of the closure element 12 which are the largest with regard to surface area. By way of example, the lower side and the upper side are aligned normally to the z-direction.

The closure element 12 preferably lies directly on the access element 11 as is shown in FIG. 1. The closure element 12 and the access element 11 are mounted in manner in which they are movable to one another, in particular in the x-direction.

Expediently, the mounting between the closure element 12 and the access element 11 is such that the access element 11 cannot be moved relative to the closure element 12 in the z-direction. By way of example, the access element 11 is mounted directly on the closure element 12. For this, suitable guide sections (not shown in FIGS. 1 to 3) can be provided, as will yet be explained hereinafter with reference to the FIGS. 11 to 20.

The closure element 12 comprises a closure element coupling section 18 with which the closure element 12 can be fastened to the particle outlet 3. Expediently, the closure element 12 can be fastened with the closure element coupling section 18 to the particle outlet 3 in a manner such that the closure element 12 is fixed relative to the particle outlet 3 in all spatial directions.

Preferably, the closure element 12 and/or the access element 11 each have a rectangular x-y base surface. Expediently, the size of the x-y base surface of the access element 11 is at least 75% and/or maximally 125% of the base surface of the closure element 12.

Now to the particle outlet 3:

The particle outlet 3 by way of example comprises an access element contact surface 5 which is aligned normally to the z-direction and in which the particle outlet opening 4 is located. The particle outlet opening 4 is preferably an opening which runs from the inner side to an outer sire of the particle outlet 3. The particle outlet opening 4 by way of example is circular and preferably has the same diameter as the access element opening 15. Expediently, the particle outlet opening 4 and the access element opening 5 are aligned when the access element 11 is situated in the open position. Alternatively, it is also possible for the particle outlet opening 4 and the access element opening 15 not to have the same diameter. Preferably, the particle outlet opening 4 with regard to surface area is 75% the size of the access element opening 15 and/or with regard to surface area is maximally 125% the size of the access element opening 15.

By way of example, the particle outlet 3 further comprises a closure element receiving section 6 which is spaced apart from the particle outlet opening 4 and expediently connects onto the access element contact surface 5 in the x-direction. The closure element receiving section 6 is designed for receiving and fastening the closure element 12. Preferably, the closure element 12 remains permanently-thus in particular in the open position and in the closure position of the access element 11—in the closure element receiving section 6 when the particle receiving device is fastened to the particle outlet 3. By way of example, the closure element receiving section 6 comprises a recess in the z-direction (in particular relative to the access element contact surface 5) for receiving the closure element 12, in particular for receiving its plate-shaped closure element body. By way of example, the lower side of the closure element 12 and the access element contact surface 5 are located at the same height in the z-direction, so that the access element 11 by way of a linear displacement in the x-direction can be moved between the open position and the closure position while having permanent bearing contact on the lower side of the closure element 12 and/or on the access element contact surface 5.

The closure element 12 is expediently located completely in the closure element receiving section 6. In particular, the closure element 12 is located outside the access element contact surface 5. The upper side and/or the lateral sides of the closure element 12 is located in a clean region-thus a region which is not contaminated by the particles. The closure element receiving section 6 can also be denoted as a clean region.

Expediently, the access element 11 in the closure position is likewise situated completely outside the access element contact surface 5.

The particle outlet 3 by way of example further comprises a fastening interface 21, in order to fasten the closure element 12 to the particle outlet 3. Purely by way of example, the fastening interface 21 comprises a latching element which can be brought into engagement with the closure element coupling section 21. By way of example, the latching element is arranged in the x-direction on the face side—the outer face side—of the closure element receiving section 6 said face side facing away from the particle outlet opening 4. The latching element by way of example comprises an actuation section which projects in the z-direction and which can be actuated in the x-direction, in order to release the engagement with the closure element coupling section 18.

The particle outlet 3 further comprises the particle outlet inner volume 9 which is accessible via the particle outlet opening 4. The particle outlet inner volume 9 for example is part of a cyclone chamber and/or is in fluidic connection with a cyclone chamber. Alternatively or additionally, the particle outlet inner volume 9 can also be part of a fluid conduit of a vacuum cleaner and/or be in fluid connection thereto.

The particle outlet 3, in a state in which the closure element 12 is attached to the access element 11 and the access element 11 is situated in the open position, is located over the access element opening 5, so that the access element opening 15 and the particle outlet opening 4 together provide the access to the particle receiving volume 14. The particle receiving volume 14 is herein expediently sealed with respect to the environment.

In particular, the arrangement 30 can be operated as follows:

In an initial state which is shown in FIG. 1, the particle receiving device 10 is not attached to the particle outlet 3. The access element 11 is situated in the closure position.

The particle receiving device 10 is attached to the particle outlet 3, in particular by way of the closure element 12 being fixed to the closure element receiving section 6. Herein, the access element 11 continues to be situated in the closure position. Expediently, the particle receiving device 10 can only be attached to the particle outlet 3 in the closure position. The access element opening 5 expediently always remains closed on attachment. The attached particle receiving device is shown in FIG. 2.

The access element 11 is then brought into the open position 11, for example by way of the displacement of the access element 11 relative to the closure element 12 and to the particle outlet 3. The access element in the open position is shown in FIG. 3.

Particles are subsequently transported out of the particle outlet inner volume 9 into the particle receiving volume 4 via the particle outlet opening 4 and the access element opening 15. In particular, this is effected by way of gravitational force and/or by way of negative pressure, in particular an airflow.

The access element 11 is then brought into the closure position, for example by way of a displacement of the access element 11 relative to the closure element 12 and to the particle outlet 3. The arrangement 30 is therefore again situated in the state which is shown in FIG. 2.

Finally, the particle receiving device 10 is removed from the particle outlet 3. The access element opening 5 preferably always remains closed given a removal from the particle outlet 3. Preferably, all regions of the particle receiving device 10 which are contaminated with particles are closed and/or covered with respect to the environment.

A second embodiment is to be discussed hereinafter with reference to the FIGS. 4 to 8. For reasons of space, the bags 17*a*, 17*b* are not completely shown in the FIGS. 5 to 8.

The second embodiment is a further development of the first embodiment. The aforementioned explanations concerning the first embodiment expediently also apply to the second embodiment. In particular, the features which are provided with a reference numeral which ends with "a" or "b" are designed in accordance with the above features which are provided with the corresponding reference numerals without "a" or "b".

Hence the particle receiving device 10 which is described previously, in the context of the second embodiment is denoted as a first particle receiving device 10*a*. The access element 11 is to be denoted as a first access element 11*a* and the closure element 12 as a first closure element 12*a*.

FIG. 4 shows an arrangement 40 according to the second embodiment. The arrangement comprises the particle outlet 3, the first particle receiving device 10*a* as well as a second particle receiving device 10*b*.

The second particle receiving device 10*b* is expediently designed in accordance with the first particle receiving device 10*a*, preferably is identical to it. The second particle receiving device 10*b* comprises a second closure element 12*b* and a second access element 11*b* which comprises a second access element opening 15*b*. The second access element 11*a* can be selectively brought into an open position or a closure position. In the closure position, the second access element opening 15*b* is closed by the second closure element 12*b*. In the release position, the second closure element 12*b* releases the second access element opening 15*b*.

The particle outlet 3 according to the second embodiment is designed in manner such that the first particle receiving device 10*a* and the second particle receiving device 10*b* can be simultaneously fastened to the particle outlet 3. The particle outlet 3 hence comprises a first closure element receiving section 6*a* and a first closure element fastening interface 21*a* for receiving and fastening the first closure element 12*a*. Additionally to this, the particle outlet 3 comprises a second closure element receiving section 6*b* and a second closure element fastening interface 21*b* for receiving and fastening the second closure element 12*b*.

The first closure element receiving section 6*a* and the second closure element receiving section 6*b* are expediently arranged in the x-direction on opposite sides of the particle outlet 3. Expediently, the particle outlet 3 is designed in a mirror-symmetrical manner relative to a y-z-plane which intersects the particle outlet 3. Preferably, the first particle receiving device 10*a* is identical and/or mirror-symmetrical to the second particle receiving device 10*b*.

A state in which both particle receiving devices 10*a*, 10*b* are attached to the particle outlet 3 is shown in FIG. 4. The first access element 11*a* is situated in the open position and the second access element 11*b* is situated in the closure position. Expediently, the first access element 11*a* and the second access element 11*b* bear on one another with their face sides, wherein the second access element 11*b* connects onto the first access element 11*a* in the x-direction.

The first access element 11*a* and the second access element 11*b* together as a group can be selectively brought into a first position or into a second position, in particular by way of a linear movement in the x-direction. The group of the first access element 11*a* and the second access element 11*b* are hereinafter to also be denoted as the first group. This first group can be displaced relative to a second group comprising the particle outlet 3, the first closure element 12*a* and the second closure element 12*b*, in order to selectively assume the first position or the second position.

The first position is shown in FIG. 6 and the second position in FIG. 7. In the first position, the first access element 11*a* is in the open position and the second access element 11*b* is in the closure position. The particle outlet opening 4 is located over the first access element opening 15*a* and together with this provides an access to the first particle receiving volume 14*a*. The second access element opening 15*b* is closed by the second closure element 12*b*.

In the second position, the first access element 11*a* is in the closure position and the second access element 11*b* is in the open position. The first access element opening 15*a* is closed by the first closure element 12*a*. The particle outlet opening 4 is located over the second access element opening 15*b* and together with this provides an access to the second particle receiving volume 14*b*.

The arrangement 40 in particular is designed in a manner such that in every possible displacement position of the first group—of the access elements 11*a*, 11*b*—the arrangement 40 is situated in a state in which each of the access element openings 15*a*, 15*b* and the particle outlet opening 4 are always closed with respect to the environment. In particular, this applies to the first position, the second position and every possible intermediate position. Expediently, the black region-thus the contamination region—of the arrangement 40 is always closed with respect to the environment. In particular, the arrangement 40 can be brought from the first position into the second position without the access element openings 15*a*, 15*b* and the particle outlet opening 4 being released with respect to the environment. The access element openings 15*a*, 15*b* are always closed with respect to the environment by way of the closure elements 12*a*, 12*b* and/or the particle outlet opening 4, and the particle outlet opening 4 is always closed with respect to the environment by way of the access elements 11*a*, 11*b* in particular the access element openings 15*a*, 15*b*.

On operation, in particular it is possible to change from one particle receiving volume 14*a*, 14*b* to the other particle receiving volume 14*a*, 14*b* without herein a region which is contaminated by particles-thus in particular the two particle capture volumes 14*a*, 14*b*, the access element openings 15*a*, 15*b*, the particle outlet opening 4 and/or the inner volume 9 of the particle outlet 3-being opened with respect to the environment of the arrangement 40.

In particular, the arrangement 40 can be operated according to the subsequently described method:

Firstly, the first particle receiving device 10*a* is attached to the particle outlet 3. The first access element 11*a* is herein situated in the closure position. The first access element 11*a* is then brought into the open position, so that the arrangement 40 assumes the state which is shown in FIG. 5. Particles are subsequently transported into the first particle receiving volume 14*a*.

Next, the second particle receiving device 10*b* is attached to the particle outlet 3. Herein, the second access element 11*b* is situated in the closure position. The attachment of the second particle receiving device 10*b* can already be effected at an earlier point in time, e.g. when the first particle receiving device 10*a* is attached or already before this.

Next, a common bringing of the first access element 11*a* into the closure position and of the second access element 11*b* into the open position is effected. The two access elements 11*a* and 11*b* herein expediently bear on one another. The particle receiving volumes 14*a*, 14*b* and the particle outlet inner volume 9 remain closed with respect to the environment.

Finally, the first particle receiving device 10*a* is removed from the particle outlet 3, wherein the particle receiving volumes 14*a*, 14*b* and the particle outlet inner volume 9 continue to remain closed with respect to the environment.

FIG. 9 shows an exemplary application for the arrangement 30 or the arrangement 40. The arrangement 30, 40 here is applied within a construction 50. The construction 50 comprises a cyclone separator 1, a container 2 and a suction device 22 with a container receiver 23.

The cyclone separator 1 is applied onto the container 2. The cyclone separator 1 by way of example is box-shaped and at its upper side expediently comprises a carrier handle 38. The particle outlet 3 is arranged on the lower side of the cyclone separator 1. Expediently, the particle outlet 3 can be removed from the cyclone separator 1, so that the cyclone separator 1 can be operated selectively with the bag 17 or without the bag 17. In the latter case, the particles are brought out into the container 2 in a direct manner and are collected there. The bag 17 is located in the container 2. The container 2 is inserted into the container receiver 23 which is located on the upper side of the suction device 22. The suction device 22 preferably comprises wheels 39 with which it can be supported and moved relative to the floor.

In particular, the suction device 22 is designed to provide a negative pressure for the cyclone separator 1, by way of which negative pressure an airflow with particles can be sucked into the cyclone separator 1. The suction device 22 is fluidically connected to the cyclone separator 1 via a fluidic conduit 24, for example a flexible tube, in order to provide the negative pressure. In particular, the fluidic conduit 24 is connected to an air outlet 25 of the cyclone separator 1.

The cyclone separator 1 further comprises an air inlet 26 on which by way of example a suction flexible tube 27 with a suction head 28 is connected. If a negative pressure is provided at the air outlet 26, for example by way of the suction device 22, then an airflow with particles is sucked through the suction head 28 and the suction flexible tube 27 into the cyclone separator 1. There, the airflow with the particles runs through a feed conduit 32 which is arranged in the cyclone separator 1 and which leads from the air inlet 26 to a cyclone chamber 33 which is arranged in the cyclone separator 1. The cyclone chamber 33 is designed according to the known functioning principle of a cyclone separator or an centrifugal force separator, in order to separate a part of the particles from the airflow. In particular, the cyclone chamber 33 is designed in a manner such that the airflow is steered onto a circular path, wherein a part of the particles which are contained in the airflow are flung onto the walls of the cyclone chamber 33 by way of the centrifugal force, so that they are braked and are finally output downwards out of the particle outlet 3.

The particles which are output out of the particle outlet 3 are collected in the bag 17. By way of example, the bag 17 is sealed, in particular in a particle-tight manner, preferably in an airtight manner, via the seal 19.

The airflow is further transported out of the cyclone chamber 33 to the air outlet 25 via a discharge conduit 34 which is located in the cyclone separator 1. By way of example, the airflow is transported through the fluidic conduit 24 into the suction device 22 and there in particular runs through a separating device 25, for example a filter, at which particles which remain in the airflow are separated away. The separated particles are collected in a particle collection volume 36 of the suction device 22, for example in a suction bag. The airflow then runs through a suction unit 37, for example a fan, which is present in the suction device and with which the negative pressure is produced.

Accordingly, the cyclone separator 1 is fluidically connected upstream of the suction device 22—thus is expediently operated as a preliminary separating stage-so that the airflow which is sucked by the suction device 22 has run through the cyclone separator 1 when the airflow reaches the suction device 21.

Hereinafter, further designs of the aforementioned particle receiving devices 10*a*, 10*b*, the particle outlet 3 and the arrangement 40 are explained with reference to the FIGS. 10 to 20. The bags 17*a*, 17*b* are not shown for reasons of an improved representation.

Figure 18:
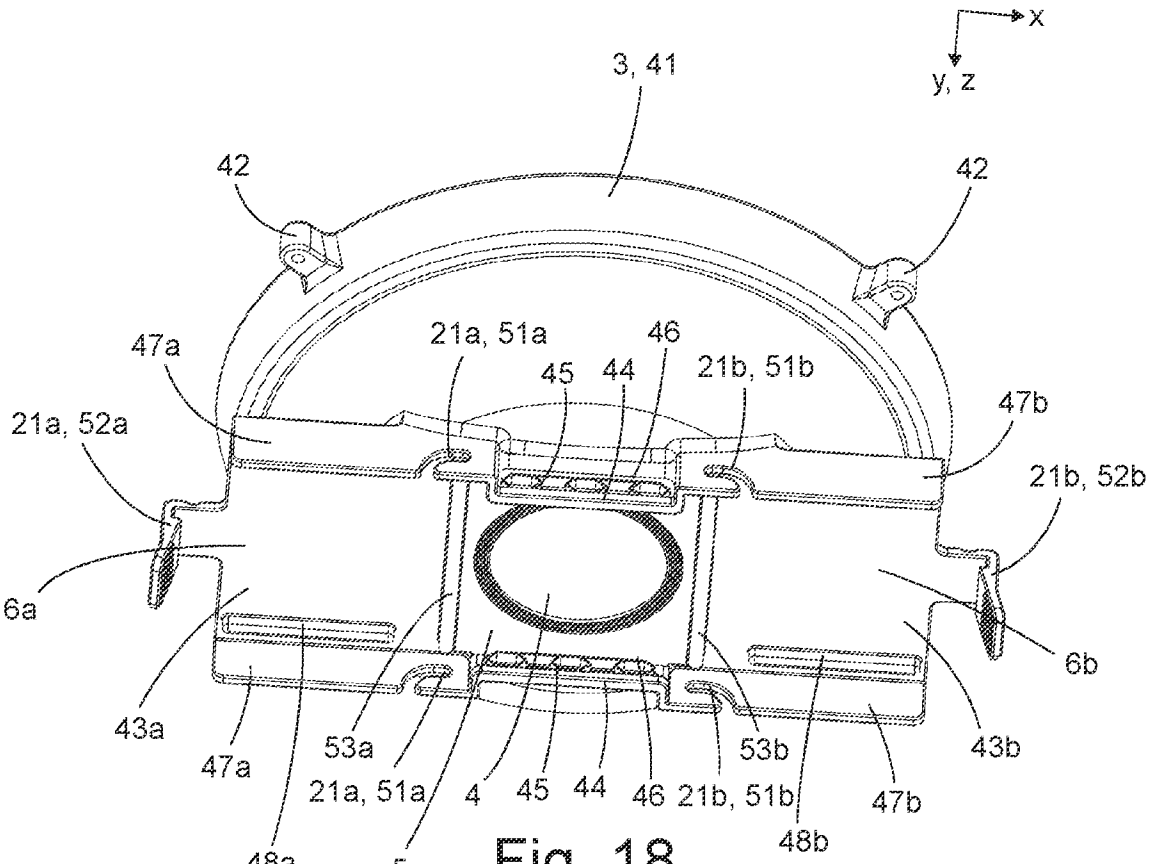
Figure 20:
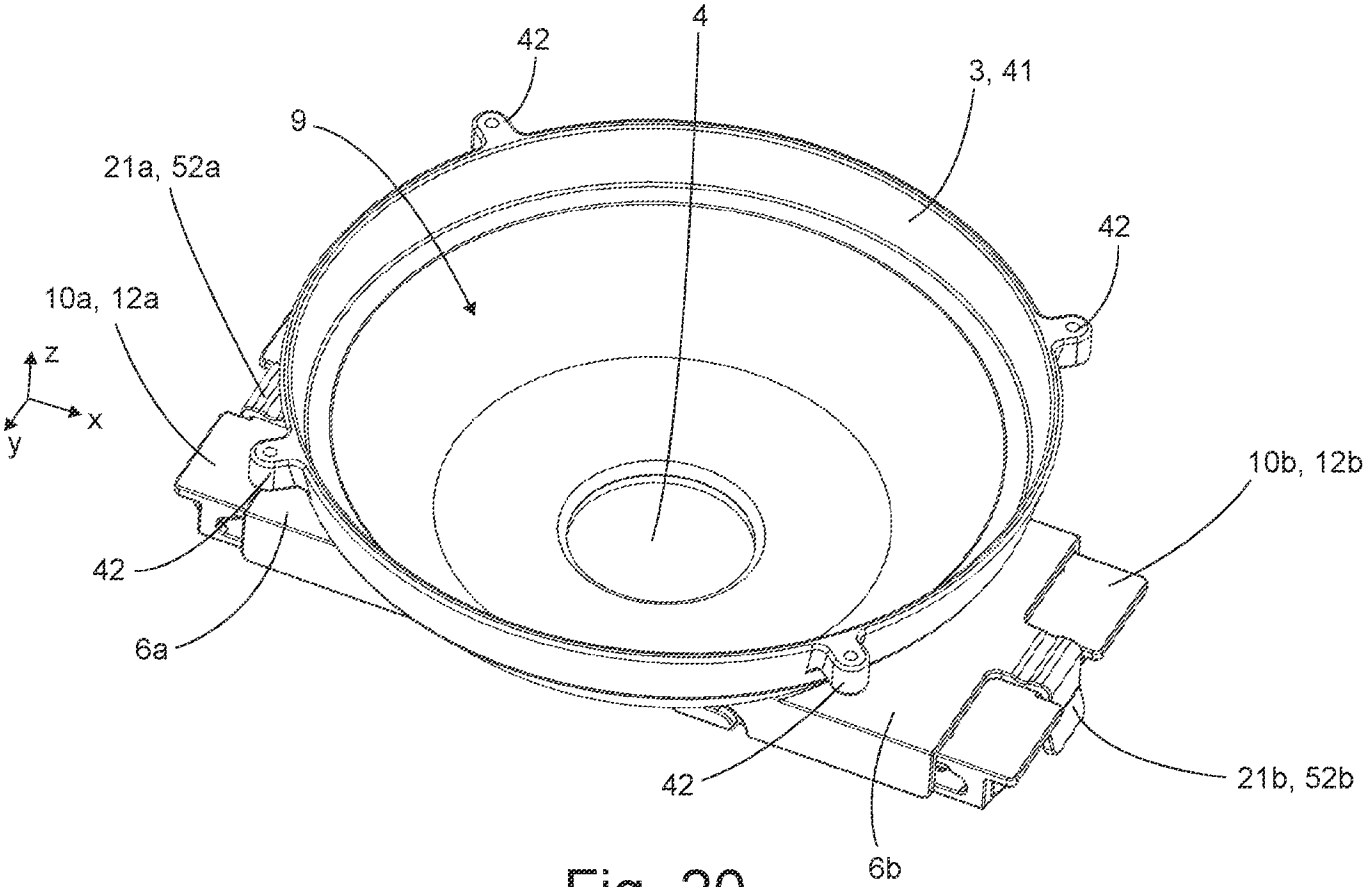

Firstly to the particle outlet 3 which in particular is shown in FIGS. 18 and 20.

The particle outlet 3 by way of example comprises a particle outlet body 41 which is expediently designed in a round, in particular bowl-like and/or funnel-like manner. The upper side of the particle outlet body 41 is expediently open, as is to be seen in FIG. 20. The access element contact surface 5 and the particle outlet opening 5 which is located therein are arranged on the lower side of the particle outlet body 41. By way of example, the particle outlet opening 5 is arranged centrally, in particular concentrically on the particle outlet body 41.

The particle outlet 3 on its lower side comprises a displacement path section which extends in the x-direction, is expediently elongate, in particular rectangular and serves for attaching the particle receiving devices 10*a*, 10*b* and the linearly movable mounting of the access elements 11*a*, 11*b*. The displacement path section is formed by the in particular rectangular access element contact surface 5 as well as the closure element receiving sections 6*a* and 6*b* which connect onto the access element contact surface 5 in the x-direction at both sides. The closure element receiving sections 6*a* and 6*b* extend in the x-direction and by way of example project from the funnel-like particle outlet body 41.

By way of example, fastening sections 42 with which the particle outlet can be fastened onto the lower side of the cyclone separator 1 are present on the upper side of the particle outlet 3. The fastening sections 42 by way of example are arranged in a manner in which they are distributed peripherally around the particle outlet body 41. The fastening sections 42 by way of example are designed as radial projections and comprise holes into which screws for example can be inserted.

The particle outlet 3 on its lower side, in particular on the displacement path section comprises fastening interfaces 21*a*, 21*b* for the particle receiving devices 10*a*, 10*b*. The fastening interfaces 21*a*, 21*b* serve for fastening the particle receiving devices 10*a*, 10*b* to the particle outlet 3 in a removable manner, in particular removable in a tool-free manner.

The subsequent explanation relates to the fastening interface 21*a*, but in a corresponding manner also applies to the fastening interface 21*b*.

Figure 19:
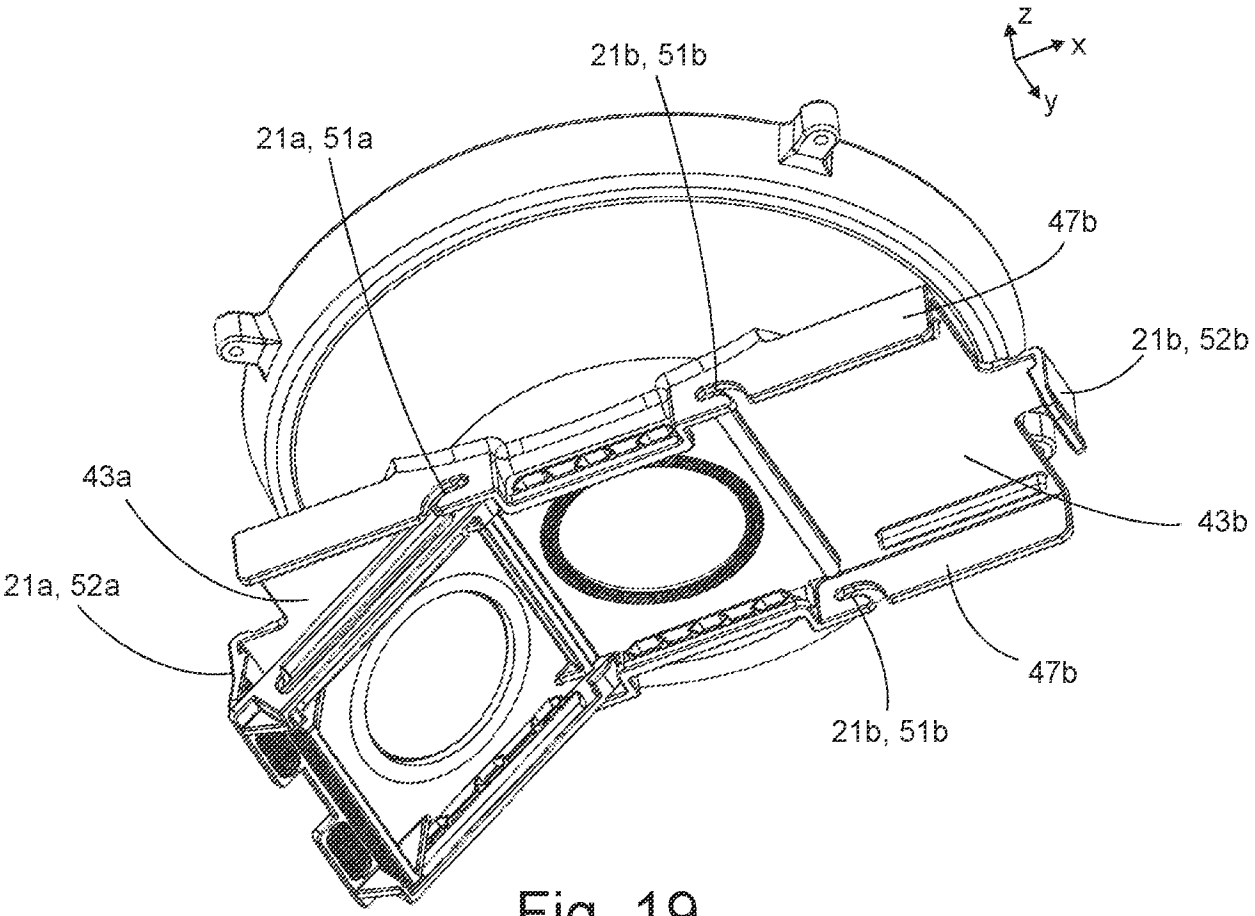

The fastening interface 21*a* expediently comprises a first coupling section 51*a* and a second coupling section 52*a*. The particle receiving device 10*a*, in particular the closure element 12*a*, as is shown in FIG. 19, is firstly attachable to the first coupling section 51*a* and then in a state in which it is attached to the first coupling section 51*a* can be attached onto the second coupling section 52*a* by way of a pivoting movement.

The first coupling section 51*a* expediently comprises two suspension slots and is preferably arranged on the two longitudinal sides of the closure element receiving section 6*a* which run in the x-direction, in particular in the region of the inner face side of the closure element receiving section 6*a*. The suspension slots by way of example are present on two side walls 47 which run in the x-direction, and the suspension slots expediently have an bent course.

The second coupling section 52*a* expediently comprises a latching element and is preferably arranged in the region of the outer face side of the closure element receiving section 6*a*. By way of example, the second coupling section 52*a* is arranged centrally in the y-direction. The latching element extends downwards in the z-direction and comprises a latching element actuation section which can be actuated in the x-direction, for example by a finger, in order to release the coupling of the second coupling section 52*a*.

The particle outlet 3 comprises the closure element contact surfaces 43*a*, 43*b* on which the closure elements 12*a*, 12*b* bear in the state attached to the particle outlet 3. The closure element contact surfaces 43*a*, 43*b* are arranged on both sides of the access element contact surface 5 in the x-direction. The closure element contact surfaces 43*a*, 43*b* are offset inwards in the z-direction relative to the access element contact surface 5, so that a deepening for receiving the closure elements 12*a*, 12*b* is present.

The particle outlet 3 comprises locking structures 53*a*, 53*b* which serve for locking the access elements 11*a*, 11*b* in the open position. The locking structures 53*a*, 53*b* by way of example are arranged between the access element contact surface 5 and the closure element contact surfaces 43*a*, 43*b* and each comprise an elongate projection which runs in the y-direction.

The particle outlet 3 further comprises unlocking structures 48*a*, 48*b* which serve for unlocking the access elements 11*a*, 11*b* relative to the closure elements 12*a*, 12*b* when the particle receiving devices 10*a*, 10*b* are fastened to the particle outlet 3. By way of example, the unlocking structures 48*a*, 48*b* comprise projections which are arranged on the closure element contact surfaces 43*a*, 43*b* and project in the z-direction. Expediently, two elongate projections which run parallel to one another in the x-direction are present per unlocking structure 48*a*, 48*b*.

The particle outlet 3 further comprises particle outlet guide sections 44 which project away from the lower side in the z-direction. The particle outlet guide sections 44 are arranged on the two longitudinal sides of the access element contact surface 5 and run in the x-direction. In the y-direction, the particle outlet opening 4 is located between the particle outlet guide sections 44. The particle outlet guide sections 44 each comprise a spring element 45. Guide slots 46 for the linearly movable guiding of the access element

11*a*, 11*b* are present between the spring element 45 and the access element contact surface.

The closure element 12*a* is to be dealt with in more detail hereinafter. Expediently, the closure element 12*b* is designed identically to the closure element 12*a*.

Figure 17:
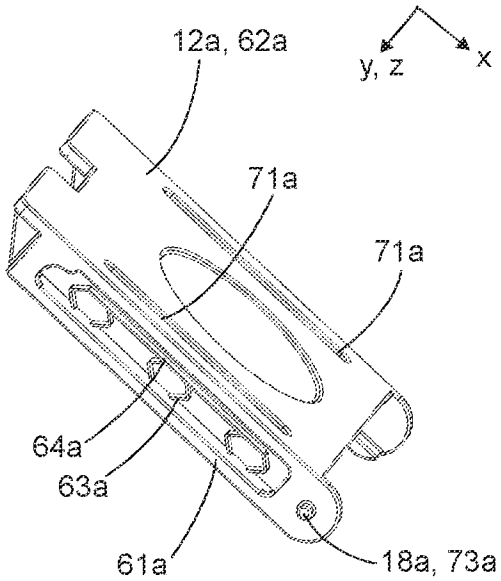
Figure 16:
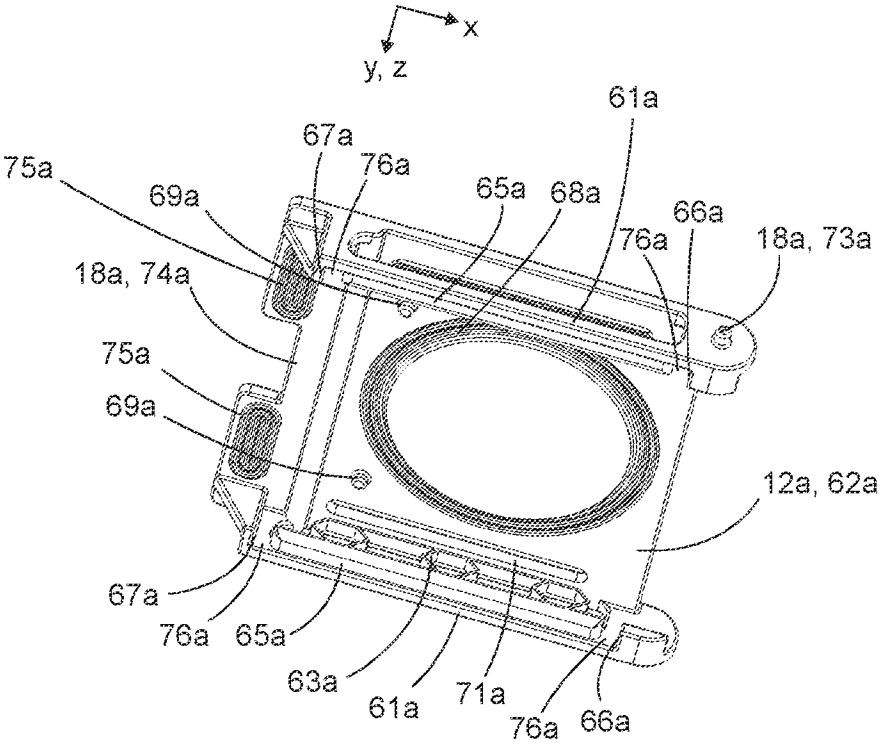

The closure element 12*a* is shown in FIGS. 16 and 17. The closure element 12*a* comprises a plate-shaped closure element body 62*a* which in particular is rectangular. Two closure element guide sections 61 project downwards away from the closure element body 62*a* in the z-direction. The closure element guide sections 61*a* are arranged on the two longitudinal sides of the closure element body 62*a* and run in the x-direction. The closure element guide sections 61*a* each comprise a spring element 63*a*. Guide slots 64*a* for the linearly movable guidance of the access element 11*a* are present between the spring element 63*a* and the closure element body 62*a* of the closure element 12*a*.

The closure element 12*a* further comprises guide webs 65*a* which project inwards in the y-direction, by way of example are arranged on the closure element guide sections 61*a* and run in the x-direction.

The closure element 12*a* further comprises first stops 66*a* which by way of example are arranged in the region of the inner face side (facing the particle outlet opening 4) of the closure element 12*a*, and second stops which by way of example are arranged in the region of the outer face side (facing away from the particle outlet opening 4) of the closure element 12. The first and the second stops 66*a*, 67*a* by way of example are arranged at the same height in the z-direction as the guide webs 65*a*. By way of example, recesses 76*a* are formed between the guide webs 65*a* and each of the stops 66*a*, 67*a*.

Furthermore, by way of example the closure element 12*a* comprises a closure element seal 68*a* which is arranged on the closure element body 62*a* and is preferably circular. The closure element seal 68*a* for example is designed as a labyrinth seal.

The closure element 12*a* further comprises a locking structure 69*a* which serves for locking the access element 11*a* in the closure position relative to the closure element 12*a*. The locking structure 69*a* comprises at least one projection which projects away from the base body 62*a* in the z-direction. By way of example, the locking structure 69*a* comprises two pin sections which project in the z-direction. Alternatively or additionally, the locking structure 69*a* can also comprise further projections, in particular a projection which can be brought into engagement with the access element opening 15*a*, for example a circular projection which can be expediently arranged within the closure element seal 68*a*.

The closure element 12*a* further comprises an unlocking structure 71*a* which contributes to the unlocking of the access element 11*a* relative to the closure element 12*a*. The unlocking structure 71*a* comprises at least one opening, through which the unlocking structure 48 of the particle outlet 3 can engage, in order to actuate the access element 11*a* and thus to unlock it. By way of example, the unlocking structure 71*a* comprises two elongate unlocking slots which run in the x-direction.

The closure element 12*a* further comprises coupling sections 18*a* for fastening the closure element 12 to the particle outlet 3, in particular to the particle outlet fastening interface 21*a*. The coupling sections expediently comprise first coupling sections 73*a* and second coupling sections 74*a*. The first coupling sections 73 by way of example are designed as pins which project outwards in the y-direction. The second coupling section 74*a* by way of example is an edge region of the (outer) faces side of the closure element 12*a* which is facing away from the particle outlet opening 4. Actuation sections 75 with which the closure element 12*a* can be pressed in the z-direction against the second coupling section 52*a* of the particle outlet 3, so that the second coupling section 74*a* of the closure element 12*a* latches into the second coupling section 52*a* of the particle outlet 3 are arranged on the second coupling section 74.

Figure 15:
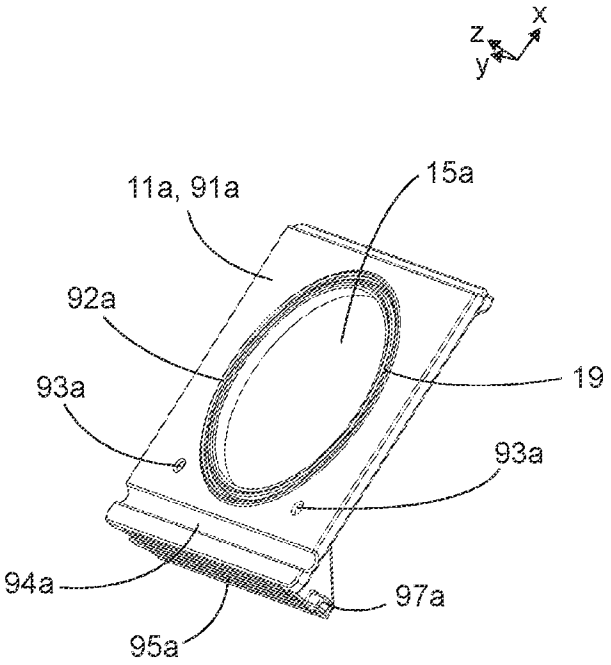
Figure 14:
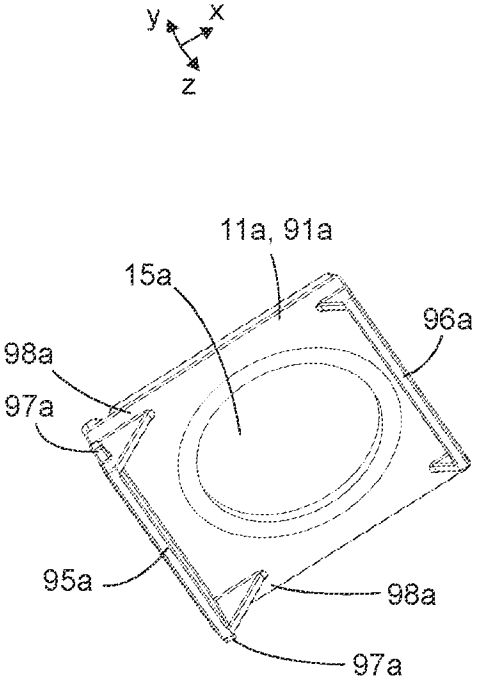

Hereinafter, the access element 11*a* which in particular is shown in FIGS. 14 and 15 will be dealt with. The access element 11*b* is expediently designed identically to the access element 11*a*.

The access element 11*a* comprises a plate-shaped access element body 91*a* which by way of example is rectangular. The access element opening 15*a* is arranged in the access element body 91*a*. Expediently, an access element seal 92*a* which is designed for example as a labyrinth seal is arranged around the access element opening 15*a*.

The access element 11*a* comprises a first locking structure 93*a* which can be brought into engagement with the locking structure 69*a* of the closure element 12*a*, in order to lock the access element 11*a* relative to the closure element 12*a* in the closure position. By way of example, the first locking structure 93*a* comprises two recesses which are present on the access element body 91*a* and which by way of example are circular.

The access element 11*a* further comprises a second locking structure 94*a* which can be brought into engagement with the locking structure 53 of the particle outlet 3, in order to lock the access element 11*a* in the open position. By way of example, the second locking structure 94*a* comprises a groove which runs in the y-direction and which is arranged in the region of the (outer) face side of the access element 11*a* which is facing away from the particle outlet opening 3.

The access element 11*a* further comprises an actuation section 95*a* which can be actuated in the x-direction by the user, in order to move the access element 11*a* in the x-direction. The actuation section 95*a* by way of example is designed as a wall-shaped projection which projects away from the access element body 91*a* in the z-direction and which is arranged on the (outer) face side of the access element 11*a* which is facing away from the particle outlet opening 3. By way of example, the actuation section 95*a* runs in the y-direction.

The access element 11*a* further comprises a contact web 96*a* which can be brought into bearing contact on the corresponding contact web 96*b* of the access element 11*b*. The contact web 96*a* projects away from the base body 91*a* in the z-direction and runs in the y-direction. The contact web is arranged on the (inner) face side of the access element 11*a* which faces the particle outlet opening 3.

Furthermore, the access element 11*a* comprises one or more projections 97*a* which can be brought into bearing contact with the first and/or second stops 66*a*, 67*a* of the closure element 12*a* which have been mentioned above, in order to limit the movement of the access element 11*a* in the x-direction. By way of example, the projections 97*a* are arranged laterally on the actuation section 95*a* and project outwards in the y-direction. The projections 97*a* by way of example are designed in a pin-like manner. The projections are arranged in the region of the outer face side of the closure element 11*a*.

The access element 11*a* further comprises guide sections 98*a* which can be brought into engagement with the guide sections 61*a* of the closure element 12*a* and/or the guide sections 44 of the particle outlet 3, in order to provide the linearly movable mounting of the access element 11*a*. The guide sections 98*a* by way of example are the longitudinal-side edges of the plate-shaped access element body 91*a*.

Figure 13:
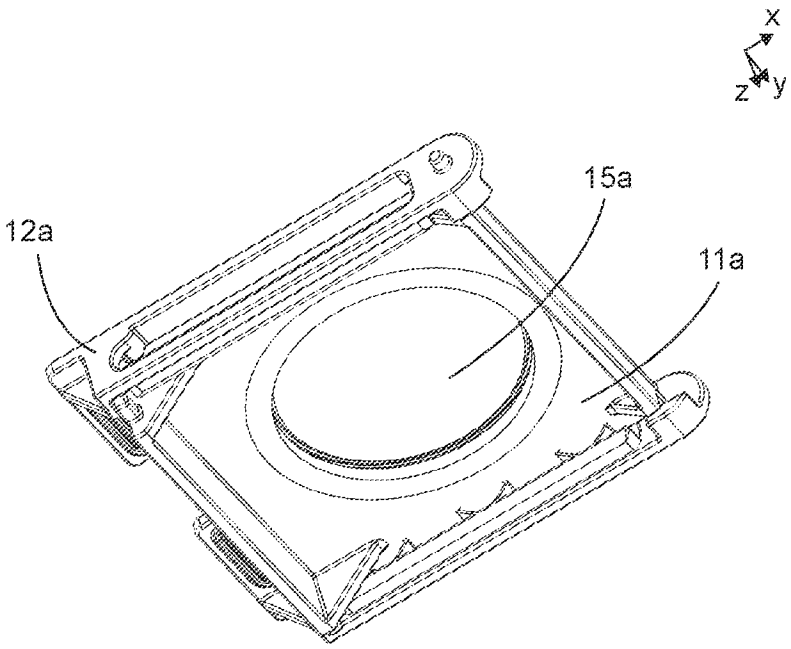

In FIG. 13, the access element 11*a* is shown together with the closure element 12*a*. The access element 11*a* is in the closure position and by way of example is located completely in the x-y region which is spanned by the closure element 12*a*. The assembly of the access element 11*a* and the closure element 12*a* can also be denoted as a closure device.

The access element 11*a*, 11*b*, the closure element 12*a*, 12*b* and/or the particle outlet 3 are expediently single-piece parts, in particular parts which are manufactured in the original shape as one piece. For example, the access element 11*a*, 11*b*, the closure element 12*a*, 12*b* and/or the particle outlet 3 can each be an injection molded part.

Figure 10:
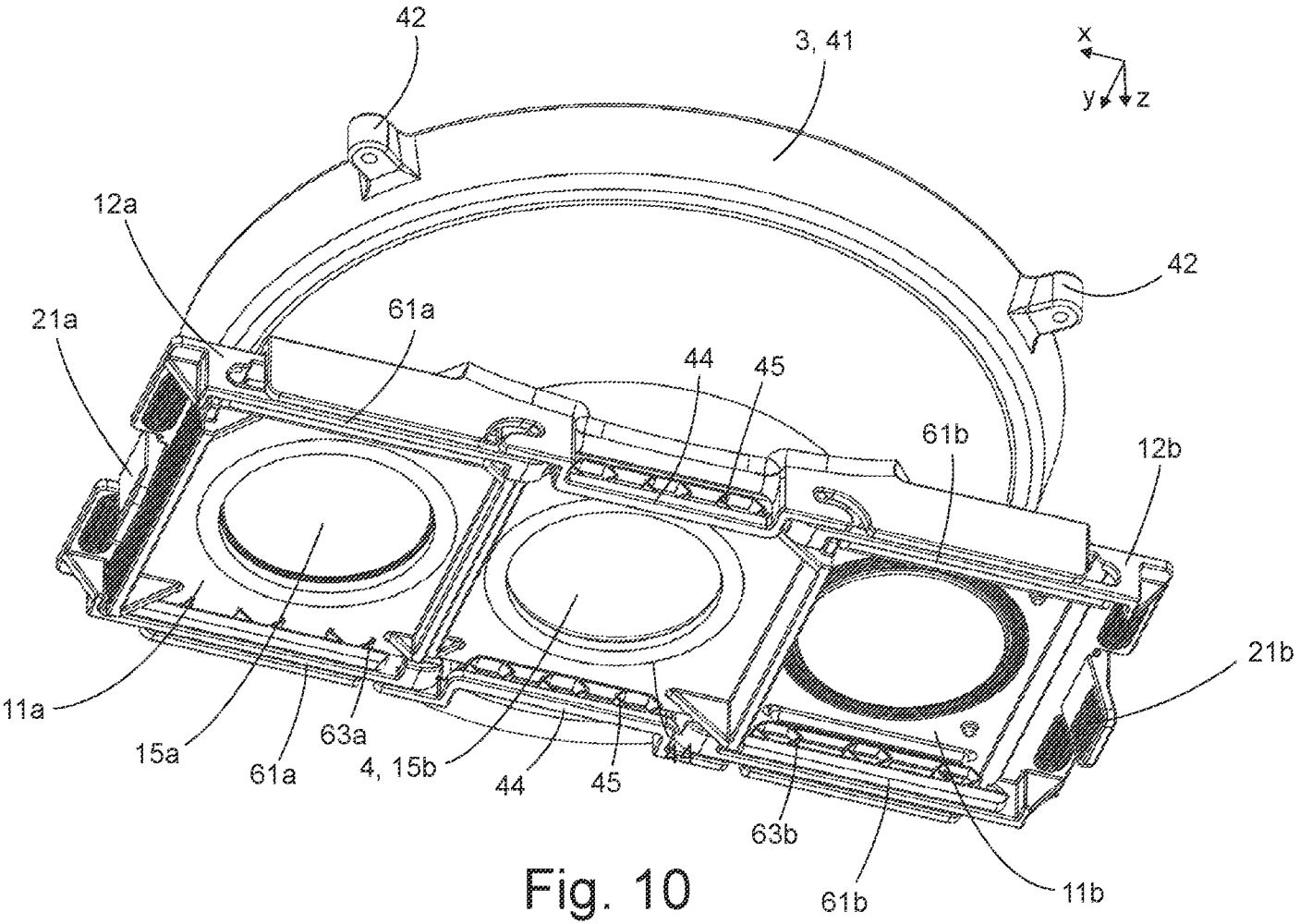

Hereinafter, the linearly movable mounting of the access elements 11*a*, 11*b* on the closure elements 12*a*, 12*b* and on the particle outlet 3 is dealt with in more detail. In particular, FIG. 10 is referred to. The subsequent explanation is made on the basis of the first particle receiving device 10*a* and in a corresponding manner applies to the second particle receiving device 10*b*.

The closure element guide section 61*a* and the particle outlet guide section 44 are designed. to mount the access element 11*a* in a lineally movable manner in the x-direction and in particular to limit and/or block a movement of the access element 11*a* in the z-direction. The closure element guide section 61*a* and the particle outlet guide section 44 extend in the x-direction and are preferably arranged in the region of the longitudinal sides of the displacement path section which run in the x-direction. The closure element guide section 61*a* and the particle outlet guide section. 44 are expediently arranged one after the other in the x-direction and are designed to each cooperate with the same access element guide section 98*a*, in order to provide a linearly movable mounting. By way of example, the side regions of the plate-shaped access element body 11*a* which run in the x-direction serve as an access element guide section 98*a*.

The closure element guide section 61*a* and the particle outlet guide section 44 by way of example each provide guide slots 46, 64*a* which run in the x-direction and into which the access element guide section 98*a* is inserted. The access element 11*a* is pressed against the closure element 12*a* and/or the particle outlet 3 by way of the spring elements 45, 63.

By way of displacement in the x-direction, the access element 11*a* can be brought from the closure position in which with its guide section 98*a* it is only in engagement with the guide section 61*a* of the closure element 12*a*, via an intermediate position in which the access element 11*a* with its guide section 98*a* is in engagement with the guide section 61*a* of the closure element 12*a* and the guide section 44 of the particle outlet 3, into the open position in which the access element 11*a* with its guide section 98*a* is only in engagement with the guide section 44 of the particle outlet 3.

Figure 11:
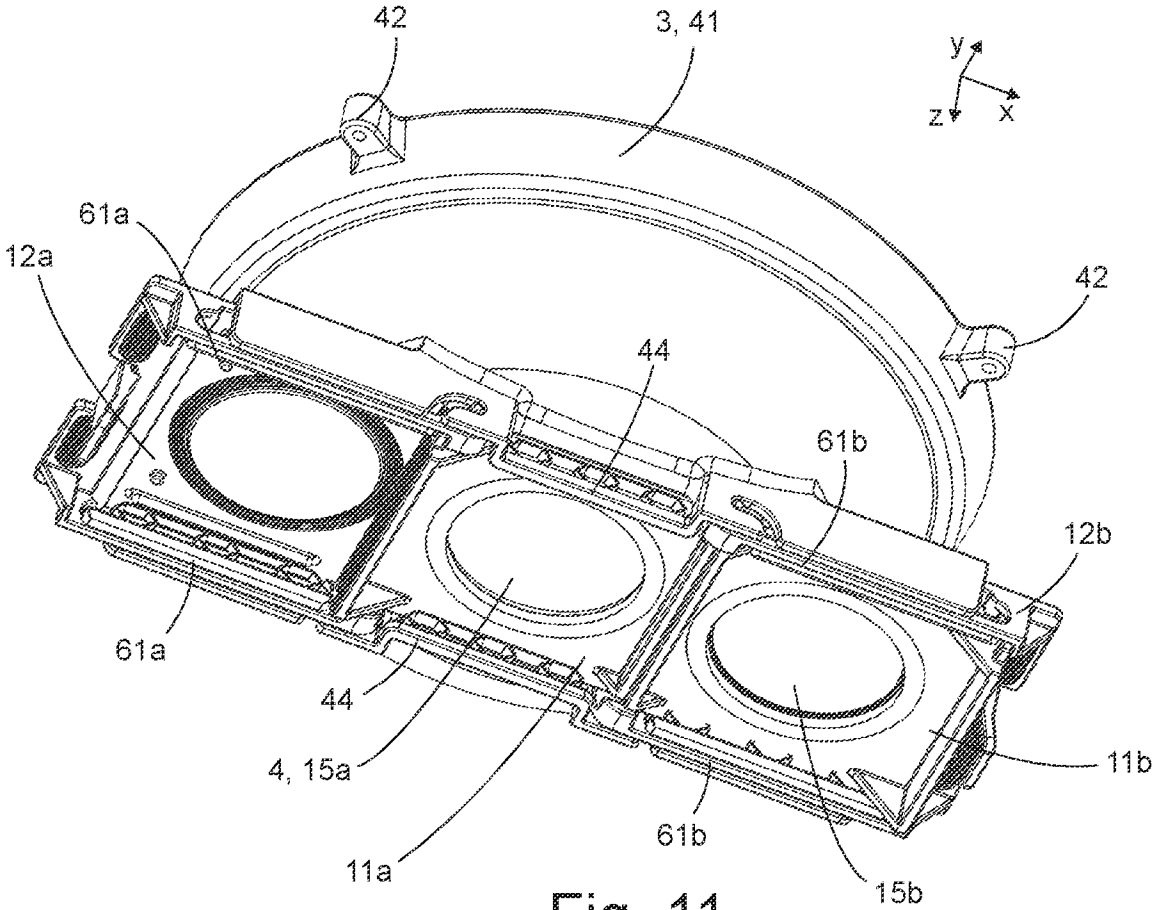

By way of the linearly movable mounting, the access elements 11*a*, 11*b* in particular together can be selectively brought into the aforementioned first position or second position. Figure shows the access elements 11*a*, 11*b* in the second position and FIG. 11 shows the access elements 11*a*, 11*b* in the first position.

Figure 12:
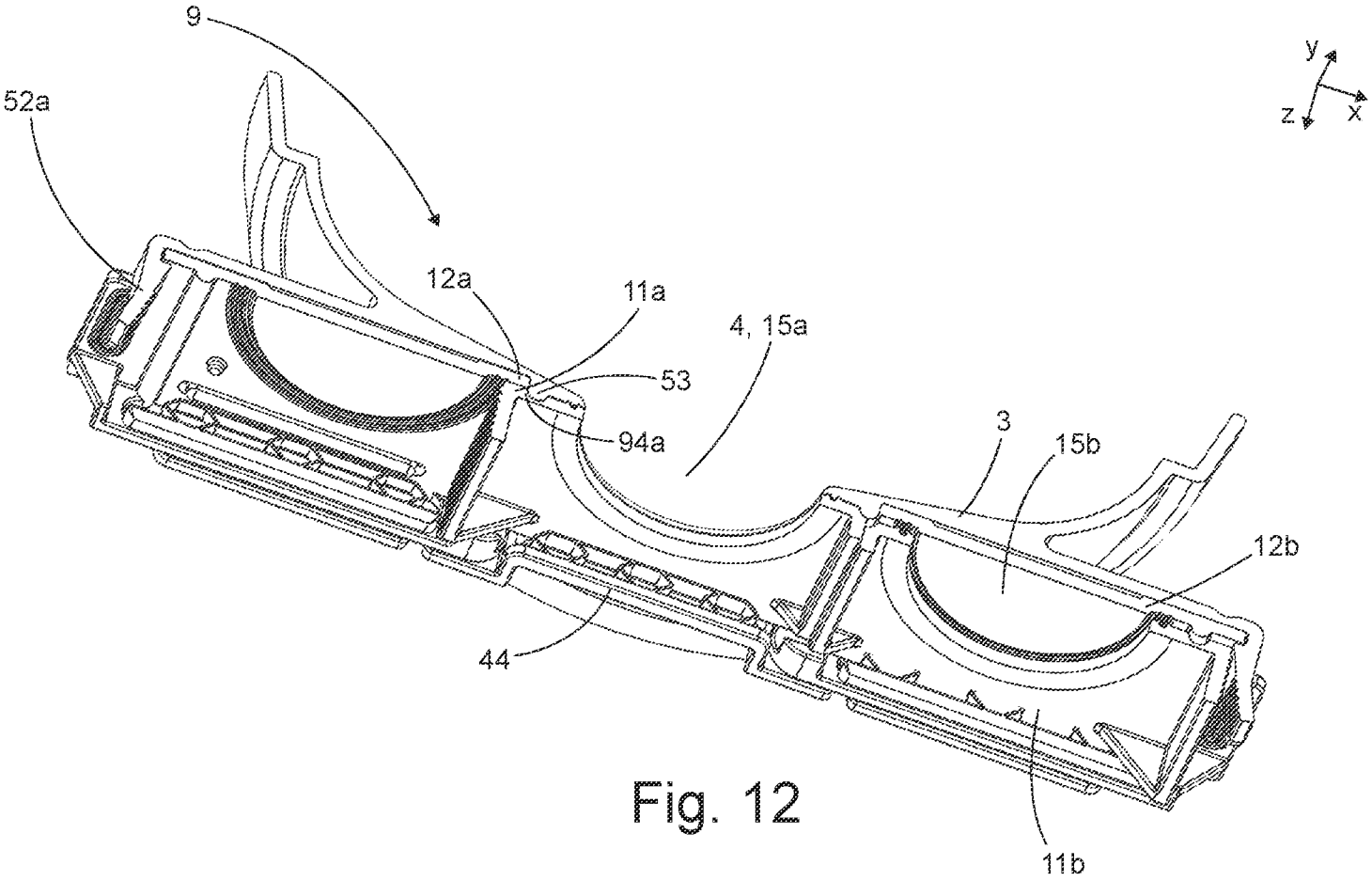

A blocking mechanism with be dealt with hereinafter, in particular with reference to FIG. 12.

Expediently, the arrangement 30, 40 comprises a blocking mechanism which prevents the particle receiving device 10*a*, 10*b* from being able to be removed from the particle outlet 3 in a position other than the closure position. A particle receiving device 10*a*, 10*b* can preferably only be removed if the respective access element 11*a*, 11*b* is situated in the closure position. This by way of example is achieved by way of the access element 11*a*, 11*b*, when it is moved out of the closure position, being brought relative to the particle outlet 3 into a mounting which prevents a removal movement which is necessary for the removal of the respective particle receiving device 10*a*, 10*b*.

The blocking mechanism is hereinafter explained by way of the first particle receiving device 10*a*; expediently the blocking mechanism can be present for the second particle receiving device 10*b* in a corresponding manner.

By way of example, the blocking mechanism is formed by the particle outlet guide sections 44, the closure element 12*a*, the access element 11*a* and the fastening interface 21*a*. As is shown in FIG. 12, the access element 11*a* overlaps the closure element 12*a* in the z-direction in a state in which the access element 11*a* is not situated in the closure position. In particular, this state is the open position. Expediently, the outer face side of the access element 11*a* overlaps the inner face side of the closure element 12*a*.

Furthermore, the access element 11*a* in the state in which the access element 11*a* is not situated in the closure position, is in engagement with the particle outlet guide sections 44.

The fastening interface 21*a*, in particular the first coupling section 51*a*, preferably the suspension slots, are now designed in a manner such that for removal of the closure element 12*a* from the first coupling section 51*a*, a removal movement is necessary, which is not possible due to the overlapping of the access element 11*a* with the closure element 12*a* and the engagement of the access element 11*a* with the particle outlet guide section 44. In particular, this is achieved by way of a pivoting movement firstly being necessary (on account of the second coupling section 52*a*) and then, on account of the bent course of the suspension slots, a movement firstly in the x-direction and then in the z-direction being necessary, for the removal of the closure element 12*a*. If the access element 11*a* is situated outside the closure position, in particular in the open position, then expediently at least one of these movements is not possible, so that overall no removal of the particle receiving device 10*a* is possible.

It is therefore ensured that for removal of the particle receiving device 10*a*, the access element 11*a* must necessarily be brought into the closure position.

A locking mechanism is to be dealt with hereinafter.

The arrangement 30, 40 by way of example comprises a locking mechanism which locks the closure element 12 with respect to the access element 11 depending on whether the particle receiving device 10 is attached to the particle outlet 3. In a state in which the particle receiving device 10 is removed from the particle outlet 3, the locking mechanism locks the access element 11 in the closure position. In a state in which the particle receiving device 10 is attached to the particle outlet, the locking mechanism unlocks the access element, so that it can be brought into the open position.

In particular, a displacement of the access element 11 in the x-direction with respect to the closure element 12 can be blocked by way of the locking mechanism.

An exemplary design of the locking mechanism is hereinafter explained by way of the first particle receiving device 10*a*. Expediently, the locking mechanism is also present for the second particle receiving device 10*b* in a manner corresponding to this.

The locking mechanism by way of example is formed by the locking structure 69 of the closure elements 12*a*, of the spring element 63 of the closure element 12*a* and the first locking structure 93*a* of the access element 11*a*.

If the access element 11*a* is in the closure position and the particle receiving device 10*a* is removed from the particle outlet 3, then the locking structure 69 of the closure element 12*a* is in engagement with the first locking structure 93*a* of the access element 11*a* and blocks a movement of the access element 11*a* relative to the closure element 12*a* in the x-direction. In particular, the pin sections of the closure element 12*a* engage into the recesses of the access element 11*a*. In order to release the engagement of the locking structure 69 with the locking structure 93*a*, by way of example a movement of the access element 11*a* relative to the closure element 12*a* in the z . . . direction is necessary, and specifically counter to the spring force of the spring element 63 which presses the access element 11*a* against the closure element 12*a* in the z-direction.

The locking mechanism by way of example further comprises the unlocking structure 48*a* of the particle outlet 3 as well as the unlocking structure 71 of the closure element 12*a*.

If the closure element 12*a* is attached to the particle outlet 3, then the unlocking structure 48*a* the engages through the unlocking structure 71 of the closure element 12*a* and presses the access element 11*a* away from the closure element 12*a* in the z-direction, so that the engagement of the locking structures 69, 93*a* is released. The access element 11*a* in this state can be moved out of the closure position by way of actuation in the x-direction.

The locking mechanism expediently further comprises the guide web 65*a* and the recess 76*a* of the closure element 12*a* as well as projections 97*a* of the access element 11*a*. In the open position of the access element 11*a*, the projections 97*a* are expediently located in the recesses 76*a* between the first stops 66*a* and the guide webs 65*a*. By way of example, the guide webs 65*a* comprise a sloped and/or rounded end region, by way of which the access element 11*a* given a movement towards the closure position is moved away from the closure element 12*a* in the z-direction, so that the access element 11*a* can be moved over the locking structure 69*a*.

A further locking mechanism is to be described hereinafter. This locking mechanism locks the access element 11*a* in the open position. Expediently, a corresponding locking mechanism is present for the access element 12*b*.

The further locking mechanism by way of example comprises the locking structure 53 of the particle outlet 3 and the second locking structure 94*a* of the access element 11*a*. In the open position, the locking structure 53 engages into the locking structure 94*a* so that it firstly requires a movement in the z-direction, in order to release this engagement and to move the access element 11*a* in the x-direction towards the closure position. The engagement of the locking structures 53, 94*a* is to be seen in FIG. 12.

The limitation of the movement of the access element 11*a* in the x-direction is to be described hereinafter. For this, the first stops 66*a* and the second stops 67*a* are present. In the open position, the projections 97*a* of the access element 11*a* bear on the first stops 66*a*, so that the access element 11*a* cannot be moved further in the x-direction in the direction away from the closure position. In the closure position, the projections 97*a* of the access element 11*a* bear on the second stops 67*a*, so that the access element 11*a* cannot be moved further in the x-direction in the direction away from the open position.

Expediently, a corresponding limitation also takes place for the access element 11*b*.

The invention claimed is:

1. An arrangement comprising a particle outlet of a vacuum cleaner and/or of a cyclone separator, the particle outlet comprising a particle outlet opening, the arrangement further comprising a particle receiving device for receiving separated particles, the particle receiving device being attached to the particle outlet and comprising:

a particle receiving volume for receiving the particles, an access element with an access element opening through which the particles can be transported into the particle receiving volume, and a closure element, wherein the access element is configured to be selectively displaced relative to the closure element into a closure position, in which the closure element closes the access element opening, or into an open position, in which the closure element releases the access element opening, wherein the particle receiving volume is closed with respect to an environment in every possible position of the access element relative to the closure element.

2. The arrangement according to claim 1, wherein the particle receiving device is a first particle receiving device and the arrangement further comprises a second particle receiving device with a second closure element and with a second access element which comprises a second access element opening, wherein the second access element can be selectively brought into an open position or a closure position, wherein in the closure position the second access element opening is closed by the second closure element.

3. The arrangement according to claim 2, wherein the first access element and the second access element together as a group can be selectively brought into a first position or a second position, wherein in the first position the first access element is in the open position and the second access element in the closure position, and in the second position the first access element is in the closure position and the second access element in the open position.

4. The arrangement according to claim 3, wherein in the first position, the second position and in all positions between the first position and the second position, the particle receiving volumes of the particle receiving devices and the particle outlet inner volume of the particle outlet are closed with respect to the environment.

5. The arrangement according to claim 1, wherein the particle outlet comprises a closure element receiving section spaced apart from the particle outlet opening and the closure element is located completely in the closure element receiving section.

6. The arrangement according to claim 1, wherein the arrangement comprises a blocking mechanism which prevents the particle receiving device from being able to be removed from the particle outlet in a position other than the closure position.

7. The arrangement according to claim 1, wherein the arrangement comprises a locking mechanism which locks the closure element with respect to the access element depending on whether the particle receiving device is attached to the particle outlet, wherein in a state in which the particle receiving device is removed from the particle outlet the locking mechanism locks the access element in the closure position and in a state in which the particle receiving device is attached to the particle outlet the locking mechanism unlocks the access element, so that it can be brought into the open position.

8. A method for operating an arrangement comprising a particle outlet of a vacuum cleaner and/or of a cyclone separator, the particle outlet comprising a particle outlet opening, the arrangement further comprising a first particle receiving device for attachment to the particle outlet and for receiving separated particles, the first particle receiving device comprising a first particle receiving volume for receiving the particles, a first access element with a first access element opening through which the particles can be transported into the first particle receiving volume, and a first closure element, wherein the first access element can be selectively displaced relative to the first closure element into a closure position, in which the first closure element closes the first access element opening, or into an open position, in which the first closure element releases the first access element opening, wherein the arrangement further comprises a second particle receiving device with a second closure element and with a second access element which comprises a second access element opening, wherein the second access element can be selectively brought into an open position or a closure position, wherein in the closure position the second access element opening is closed by the second closure element, the method comprising the steps:

attaching the first particle receiving device to the particle outlet, wherein the first access element is situated in the closure position, bringing the first access element into the open position, transporting the particles into the first particle receiving volume, attaching the second particle receiving device to the particle outlet, wherein the second access element is situated in the closure position, together bringing the first access element into the closure position and the second access element into the open position, wherein the particle receiving volumes are closed with respect to the environment, removing the first particle receiving device from the particle outlet, wherein the first particle receiving volume remains closed with respect to the environment.

9. The arrangement according to claim 1, wherein the closure element comprises a closure element coupling section with which the closure element can be fastened to the particle outlet.

10. The arrangement according to claim 9, wherein the access element comprises an upper side which in the open position of the access element represents an outer side of the particle receiving device and can be applied onto the particle outlet.

11. The arrangement according to claim 9, wherein the closure element is arranged on the upper side of the access element.

12. The arrangement according to claim 9, further comprising a bag and/or a container for providing the particle receiving volume, wherein the bag and/or the container is fastened to the access element and is movable together with the access element relative to the closure element.

13. The arrangement according to claim 9, wherein, when the access element is situated in the closure position, the closure element completely covers the upper side of the access element, which upper side can be applied onto the particle outlet.

14. An arrangement comprising a particle outlet of a vacuum cleaner and/or of a cyclone separator, the particle outlet comprising a particle outlet opening, the arrangement further comprising a particle receiving device for receiving separated particles, the particle receiving device being attached to the particle outlet and comprising:

a particle receiving volume for receiving the particles, an access element with an access element opening through which the particles can be transported into the particle receiving volume, and a closure element, wherein the access element can be selectively displaced relative to the closure element into a closure position, in which the closure element closes the access element opening, or into an open position, in which the closure element releases the access element opening, wherein the particle receiving device is a first particle receiving device and the arrangement further comprises a second particle receiving device with a second closure element and with a second access element which comprises a second access element opening, wherein the second access element can be selectively brought into an open position or a closure position, wherein in the closure position the second access element opening is closed by the second closure element, wherein the first access element and the second access element together as a group can be selectively brought into a first position or a second position, wherein in the first position the first access element is in the open position and the second access element in the closure position, and in the second position the first access element is in the closure position and the second access element in the open position.

* * * * *